United States Patent [19]

Parker

[11] Patent Number: 4,537,021

[45] Date of Patent: Aug. 27, 1985

[54] FRICTION SPINNING

[75] Inventor: Alan Parker, Bolton, England

[73] Assignee: Hollingsworth (U.K.) Limited, United Kingdom

[21] Appl. No.: 618,974

[22] Filed: Jun. 11, 1984

[30] Foreign Application Priority Data

Jun. 15, 1983 [GB] United Kingdom ..... 8316341
Feb. 2, 1984 [GB] United Kingdom ..... 8402838

[51] Int. Cl.[3] ..... D01H 7/898
[52] U.S. Cl. ..... 57/401
[58] Field of Search ..... 57/400, 401, 408, 411

[56] References Cited

U.S. PATENT DOCUMENTS

| | | | |
|---|---|---|---|
| 4,168,601 | 9/1979 | Didek et al. | 57/401 |
| 4,202,163 | 5/1980 | Turk et al. | 57/401 |
| 4,281,507 | 8/1981 | Didek et al. | 57/411 X |
| 4,367,623 | 1/1983 | Parker et al. | 57/401 X |

*Primary Examiner*—Donald Watkins
*Attorney, Agent, or Firm*—Donald H. Feldman

[57] ABSTRACT

A friction spinning apparatus and process use at least one perforated roller enclosing a suction sleeve having the static pressure applied along its suction slot changing between a tip end of the fibre bundle forming the yarn and a downstream location of the fibre bundle whereby the tip end is subjected to a weaker suction effect holding it against the surface than is the stronger downstream part of the fibre bundle.

10 Claims, 5 Drawing Figures

FRICTION SPINNING

The present invention relates to friction spinning, and in particular to the application of suction to hold a forming yarn on a perforated surface in friction spinning.

There have been various proposals for friction spinning of yarn, in particular our own British Patent Publication No. 2,042,599A (originally filed in the name Platt Saco Lowell Limited) and various proposals by Dr. Ernst Fehrer, Barmag Barmer AG, and Vyzkumny Ustav Bavinarsky.

Generally, a friction spinning process comprises directing an airborne stream of discrete fibres between two surfaces which are moving contrary to one another, for example between the surfaces of two closely spaced rollers which are rotating in the same sense, or to the nip between the internal surface of a drum and the external surface of a roller eccentrically mounted within the drum.

British Patent Publication No. 2,023,196A (Vyzkumny Ustav Bavinarsky) discloses at FIG. 16 the provision of varying distributions of the apertures of the perforated internal drum such that the population of the apertures becomes denser along the drum in the direction of yarn withdrawal. However, there is no suggestion that the pressure drop across each aperture will be other than substantially constant.

In U.S. Pat. No. 4,168,601 (Didek et al—Assignors to Vyzkumny Ustav Bavinarsky) there is a disclosure of having the "sucking effect" increase along a direction of yarn withdrawal, and achieving this increase by virtue of the sizes of the suction apertures through the roller increasing along the direction of yarn take off. Clearly, by having larger holes there will be a greater cross-section to the air stream flowing through the holes (and possibly even a higher air velocity which will result in an increased total pressure of the air on the holes), but this does not require a changing static pressure along the drum.

By contrast, in accordance with the present invention we provide a friction spinning process in which the static pressure differential across the fibre bundle forming the yarn to hold the bundle in contact with a perforated friction spinning surface is lower at the tip end of the forming yarn than at a downstream location.

Hand-in-hand with this important increase in the static air pressure, there may of course be variations in the airflow rate and/or the air velocity, but we believe it is the static pressure which is the important variable in the forming of yarn by this process.

When the static pressure applied increases along the direction of yarn withdrawal, the static pressure applied at the fragile tip is less than that applied downstream where more of the fibres have collected together with those which entered adjacent the tip end of the forming yarn, and where the twisting of the overall matrix of the yarn has already increased its structural integrity. By avoiding imposing too high a static pressure difference across the yarn near the fragile tip, where its cross-section will be smaller than downstream along the yarn, we reduce the incidence of destruction of the yarn build-up with ensuing breaking of the yarn and the need for piecing-up the apparatus afresh.

The present invention also provides friction spinning apparatus comprising co-operating movable surfaces of which at least one is perforated, suction means to generate a static pressure which is different at different locations along a line perpendicular to the direction of movement of the perforated surface, and means for withdrawing yarn from said co-operating surfaces along a yarn formation line parallel to said line of different pressure locations, the static pressure applied through the perforated surface reducing in the yarn withdrawal direction so that weaker suction is exerted at the tip of the forming yarn than at a downstream portion.

In order that the present invention may more readily be understood the following description is given, merely by way of example, with reference to the accompanying drawings in which.

Figure 1:
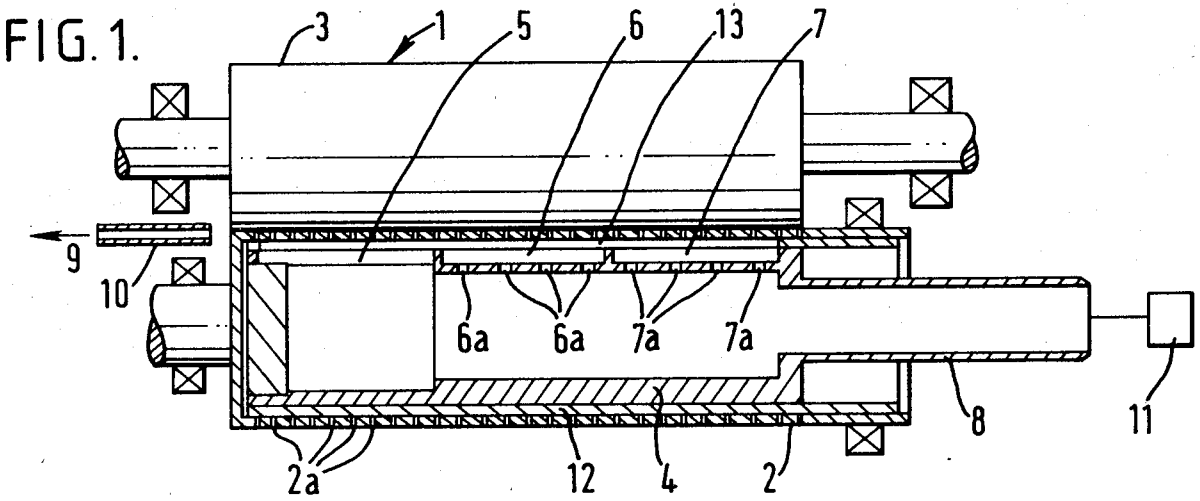
FIG. 1 shows a top plan view, in partly sectional form, of the friction spinning rollers of a friction spinner in accordance with the present invention.

The apparatus shown in the drawings is of the generic type illustrated in our said published British Patent Application No. 2,042,599A the disclosure of which is incorporated in this specification by reference. We therefore omit from the present application illustrations of the important friction spinner constituents of a fibre opening unit, and a fibre feed duct to the rollers. The nature of each of these components can readily be appreciated from our said published patent application No. 2,042,599A, and since the present invention is concerned with the application of variable static pressure to the yarn we illustrate in the drawing only those components which are different from the corresponding components in our own prior art reference.

FIG. 1 shows friction spinning apparatus 1 comprising a foraminous roller 2 having a plurality of small diameter holes 2*a* uniformly distributed along a considerable part of its surface and mounted closely alongside a non-perforated roller 3. These holes are shown exaggerated in size in the drawing in order to avoid complicating the drawing.

Within the foraminous roller 2 is a first or intermediate sleeve 12 having a rectilinear slot 13 defining a suction slot running parallel to and adjacent to the nip between foraminous roller 2 and the adjacent co-operating imperforate roller 3.

A third or inner sleeve 4 mounted within the hollow roller 2 has three slot portions 5, 6, 7 extending parallel to its axis facing the nip between the rollers 2 and 3, so that suction may be applied through the slot portions 5, 6 and 7 and through the holes 2*a* of the overlying part of the perforated surface of the roller 2 to attract fibres towards the nip between the two rollers 2 and 3.

The suction applied at the slot portion 5 is communicated from a suction source 11 by way of a suction conduit 8 extending coaxially with the hollow roller 2. This suction conduit 8 communicates with all three of the slot portions 5, 6 and 7.

Suction from the suction conduit 8 is applied to each of the three slot portions 5, 6, 7, but whereas it is applied to the lefthand slot portion 5 substantially without any attenuation, it is applied to the centre slot portion 6 by way of four equally spaced holes 6*a* (of a first diameter) in the floor of slot portion 6, and likewise it is applied to slot portion 7 through its floor by way of four further equally spaced holes 7*a* of a second diameter smaller than that of the holes 6*a*. This has the result of generating a static pressure in the lefthand slot portion 5 which is lower than that in the central slot portion 6, this being in turn lower than that in the righthand slot portion 7 at which the delicate tip of the fibre bundle forming the yarn is located.

In one preferred example the three slot portions 5, 6 and 7 are equal in length (for example substantially 40 mm) and the holes 6*a* may have a diameter of 3 mm and the holes 7*a* have a diameter of 2 mm. This may, for example, result in a suction at slot portion 7*a* equal to 10 inches water gauge (2.5 kPa), a suction in the slot portion 6*a* equal to 20 inches water gauge (5 kPa), and a suction in the lefthand slot portion 5 equal to 30 inches water gauge (7.5 kPa).

An alternative arrangement may be one in which the floor of slot portion 6 is also completely open and thus the higher suction of 7.5 kPa may be applied along two of the three parts 5, 6, 7 of the slotted length of the sleeve 4.

It will be appreciated that the holes 6*a* and 7*a* throttle the fluid flow path from slot portions 6 and 7 differently from one another, and to a different degree as compared with the path from the slot portion 5.

We find that by ensuring that the static pressure within the sleeve 4 is lower at the righthand end (suction is stronger there) than it is at the lefthand end where the fragile tip of the fibre bundle is located, the fragile tip is subjected to minimum suction just enough to hold it in contact with the surface of the perforated roller 2 whereas further along the surface of roller 2, in the direction 9 of yarn take-off through the schematically illustrated doffing tube 10 and between the twist-blocking withdrawal rollers (not shown), the suction effect is stronger in order to ensure that there is a friction-imparting normal reaction between the forming yarn in the fibre bundle and the perforated surface such as to apply maximum friction and hence maximum twisting movement on the yarn.

The precise mechanism by which the present invention achieves its highly advantageous results is not fully understood but it is thought that the entire fibre bundle and the adjacent end of the yarn act as a continuous cylindrical body which rotates with respect to some downstream twist-blocking means such as withdrawal rollers, thereby imparting actual twist to the yarn to effect the spinning operation. Since the suction effect is instrumental in maintaining the desired friction between the surface 2 and the fibre bundle, and therefore has the secondary effect of drawing the yarn into the nip between the surface 2 and the non-perforated surface 3 which also imparts frictional twisting moment to the yarn, it is advantageous to achieve maximum suction effect at that end of the fibre bundle where all of the fibres have become attached (i.e. the end nearer the withdrawal means), and to economise on the suction effect by not subjecting the tip end of the fibre bundle to the full suction effect. This has the further important advantage of avoiding subjecting the fragile tip to high suction and friction effects which might destroy it.

Figure 2:
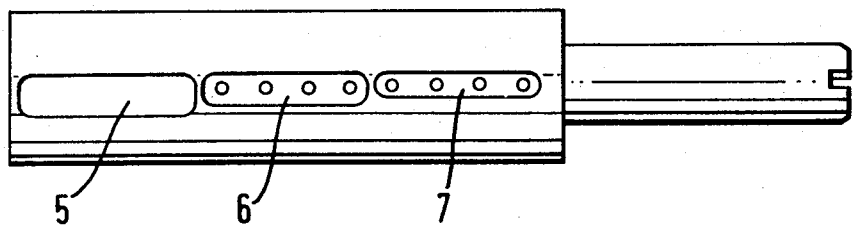
FIG. 2 shows an elevational view of the inner sleeve of the perforated roller of FIG. 1.
Figure 3:
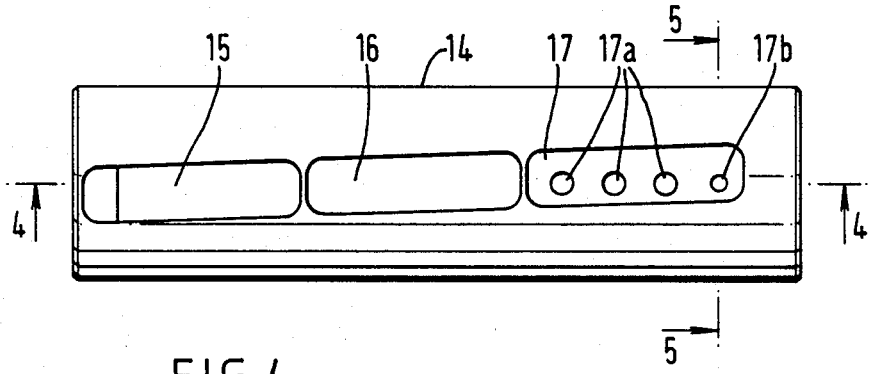
FIG. 3 is a side elevational view of a second embodiment of the inner sleeve shown in FIG. 2.
Figure 4:
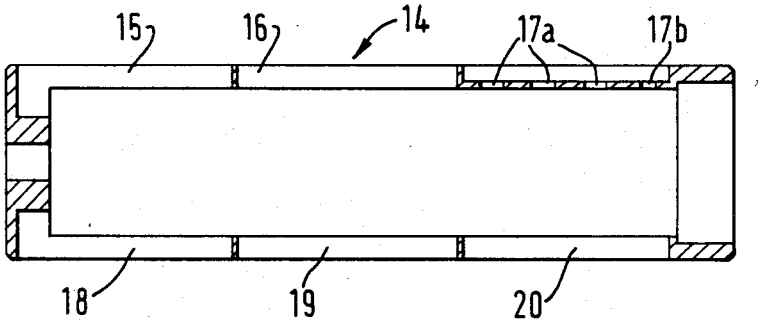
FIG. 4 is a section taken on the line 4—4 of FIG. 3.
Figure 5:
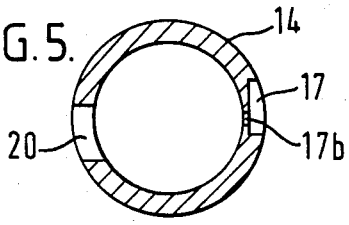
FIG. 5 is a section taken on the line 5—5 of FIG. 3.

A second embodiment of the inner sleeve is shown at 14 in FIGS. 3 to 5. In this case the suction slot is formed of three separate slot portions 15, 16 and 17 which correspond substantially to the slot portions 5, 6 and 7 of FIGS. 1 and 2 but are here arranged on a helical line on the perimeter of the sleeve 14. In this case the slot portions 15 and 16 are entirely open whereas the slot portion 17 is provided with three holes 17*a* and a fourth hole 17*b* of a smaller diameter than the other three. Thus the static pressure at the surface of the outer sleeve 2 directly in register with the slot portions 15 and 16 will be substantially uniform whereas the static pressure in register with the slot portion 17 will be closer to atmospheric (i.e. at a less pronounced suction) and will be non-uniform in that the value closest to atmospheric will occur just radially outwardly of the righthand, smallest diameter, hole 17*b*.

The sleeve 14 has, diametrically opposite to the side where the slot portions 15, 16 and 17 occur, a separate slot, again helical, composed of three slot portions 18, 19 and 20.

The advantage of this second embodiment of sleeve 14 over and above the first embodiment 4 shown in FIGS. 1 and 2 is that it can be rotated through 180° in order to present a different one of the two slots, namely either the first slot 15, 16, 17 in which static pressure varies along the suction slot, or the second suction slot 18, 19, 20 in which the static pressure or suction is substantially uniform along the slot.

Although in this particular embodiment there is a substantially uniform static pressure in one of the two slots, it would alternatively be possible for both of the slots to exhibit a variation of static pressure but for the pattern of variation to differ from the one slot to the other, and equally it would be possible to incorporate more than two of the helical slots, each having a different static pressure pattern applicable at the surface of the outer sleeve 2 defining the perforated roller of the friction spinning apparatus.

By using the type of slotted sleeve illustrated in FIGS. 3, 4 and 5, it is possible to change the static pressure pattern along the perforated friction spinning roller 2 without the need to dismantle the entire apparatus, but simply by rotating the inner sleeve to bring a different suction slot into line with the slot of the intermediate sleeve (now shown in FIG. 1) of the perforated roller assembly.

It will of course be understood that the helical arrangement of the slot shown in FIGS. 3, 4 and 5, and the analogous effect derived from the differing widths of the slot portions 5, 6 and 7 shown in FIG. 2, is such that when the inner slot 4 or 14 co-operates with the intermediate blanking sleeve 12 having its slot 13 rectilinear and disposed along a generatrix of the intermediate sleeve (as disclosed in our published European Patent Application Nos. 0,034,427 and 0,052,412) a progressive application of suction along the slot of the blanking sleeve is possible.

Accordingly, the present invention gives a more reliable process as regards the incidence of yarn breaks, and does so without necessarily requiring a variation in either the hole size or the density of population of the holes 2*a* along the perforated roller 2. However, it is possible to vary these other parameters of size and population density together with the variation of static pressure on the yarn, if considered desirable, without departing from the scope of the present invention.

I claim:

1. In friction spinning apparatus comprising:

(a) co-operating first and second movable surfaces of which at least said first surface is perforated, said first and second surfaces defining a yarn formation line transverse to which the first and second surfaces move;

(b) suction means to generate suction within said first surface along a line thereof perpendicular to the direction of movement of the perforated surface; and (c) means for withdrawing yarn from said co-operating surfaces along a yarn formation line parallel to said suction line;

the improvement wherein said suction means are effective to ensure that the static pressure within said first surface is different at different locations along said suction line and the static pressure reduces in the yarn withdrawal direction so that weaker suction is exerted at the tip of the forming yarn than at a downstream portion thereof.

2. Friction spinning apparatus according to claim 1, including several regions of said different static pressure between the ends of said suction line, the static pressure within a respective said region being substantially constant.

3. Friction spinning apparatus according to claim 2, including a body behind said perforated surface and wherein said regions of different substantially constant static pressure are defined by isolated slot portions along said body, said isolated slot portions defining said suction line, and the difference in static pressures is due to differently throttled fluid flow paths from each of said slot portions towards the suction source, said suction means comprising said body and said suction source.

4. Friction spinning apparatus according to claim 3, wherein at least one of said isolated slot portions has a floor penetrated by apertures which communicate said slot portion with the suction source and comprise the throttled flow path from that slot portion.

5. Friction spinning apparatus according to claim 3, wherein said isolated slot portions together define first slot means along said suction line of said body to generate a first static pressure pattern along said body, and including second slot means defined along a different said suction line and differently designed to generate a second static pressure pattern on the exterior of the perforated surface which is different from said first static pressure pattern, whereby rotation of the body between first and second positions brings said first slot means or said second slot means into register with said yarn formation line.

6. Friction spinning apparatus according to claim 3, wherein said perforated surface is defined by a perforated external sleeve, and said body is an internal sleeve defining said isolated slot portions; and further including an intermediate blanking sleeve radially outwardly of the inner sleeve but radially inwardly of the perforated sleeve, said intermediate blanking sleeve defining a single rectilinear slot based on a generatrix of the intermediate sleeve, said isolated slot portions of said inner sleeve being disposed to form a generally helical slot.

7. Friction spinning apparatus according to claim 1, wherein said second surface is non-perforated.

8. Friction spinning apparatus according to claim 1, wherein said first and second friction spinning surfaces are the external surfaces of first and second parallel rotatable cylindrical rollers.

9. In a friction spinning process comprising feeding a stream of fibres onto perforated moving friction spinning surface means while applying suction through said surface means to hold a bundle of said fibres on said moving surface means, the improvement wherein the static pressure differential across said surface means to hold the bundle in contact therewith is lower at the tip end of the forming yarn than at a downstream location thereof.

10. A friction spinning process according to claim 9, wherein there is a region of substantially constant static pressure differential across the surface means along the tip end of the fibre bundle and a region of substantially constant higher static pressure differential across the surface means along a part of the fibre bundle at a downstream location.

* * * * *